US011971041B2

(12) United States Patent
Galtry et al.

(10) Patent No.: US 11,971,041 B2
(45) Date of Patent: Apr. 30, 2024

(54) DRAG PUMP

(71) Applicant: Edwards Limited, Burgess Hill (GB)

(72) Inventors: Michael Andrew Galtry, Burgess Hill (GB); Miles Geoffery Hockliffe, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 0 days.

(21) Appl. No.: 17/629,602

(22) PCT Filed: Jul. 24, 2020

(86) PCT No.: PCT/EP2020/070925
§ 371 (c)(1),
(2) Date: Jan. 24, 2022

(87) PCT Pub. No.: WO2021/013979
PCT Pub. Date: Jan. 28, 2021

(65) Prior Publication Data

US 2022/0299036 A1 Sep. 22, 2022

(30) Foreign Application Priority Data

Jul. 25, 2019 (GB) ..... 1910647

(51) Int. Cl.
*F04D 19/04* (2006.01)
*F04D 17/16* (2006.01)
*F04D 29/32* (2006.01)

(52) U.S. Cl.
CPC ..... *F04D 19/04* (2013.01); *F04D 17/168* (2013.01); *F04D 19/044* (2013.01); *F04D 29/32* (2013.01)

(58) Field of Classification Search
CPC .... F04D 17/122; F04D 17/161; F04D 17/168; F04D 19/04; F04D 19/042; F04D 29/32; F04D 29/324
See application file for complete search history.

(56) References Cited

U.S. PATENT DOCUMENTS 3,924,962 A 12/1975 Maurice
3,947,193 A 3/1976 Maurice
(Continued)

FOREIGN PATENT DOCUMENTS

DE 605902 C 11/1934
EP 2995819 A1 3/2016
(Continued)

OTHER PUBLICATIONS

British Examination Report dated Jan. 14, 2020 and Search Report dated Jan. 13, 2020 for corresponding British Application No. GB1910647.5, 6 pages.
(Continued)

*Primary Examiner* — Juan G Flores
*Assistant Examiner* — Jason G Davis
(74) *Attorney, Agent, or Firm* — Theodore M. Magee; Westman, Champlin & Koehler, P.A.

(57) ABSTRACT

A drag pump for pumping fluid from an inlet to an outlet includes a stator and a rotor. One of the stator or rotor includes a disc having a plurality of channels each of the channels extending from an inlet portion of the disc at or close to an inlet edge towards an outlet portion at or close to an outlet edge. The plurality of channels each has walls for guiding fluid flow from the inlet edge to the outlet edge in response to relative motion between the stator and the rotor. The disc further includes a plurality of protrusions extending from the channels, each of the protrusions being arranged to divide a channel at the inlet or the outlet end of the channel, into sub-channels that extend for a portion of a length of the channel and do not extend for a whole length of the channel.

15 Claims, 5 Drawing Sheets

(56) References Cited

U.S. PATENT DOCUMENTS

| | | | | |
|---|---|---|---|---|
| 3,969,039 | A * | 7/1976 | Shoulders | F04D 25/045 417/244 |
| 8,070,419 | B2 * | 12/2011 | Helmer | F04D 17/168 415/90 |
| 8,152,442 | B2 * | 4/2012 | Helmer | F04D 17/168 415/55.1 |
| 9,702,374 | B2 * | 7/2017 | Emelli | F04D 17/02 |

FOREIGN PATENT DOCUMENTS

| | | | |
|---|---|---|---|
| GB | 1459933 | | 12/1976 |
| GB | 1473713 | | 5/1977 |
| WO | 2007041932 | A1 | 4/2007 |
| WO | 2009153874 | A1 | 12/2009 |

OTHER PUBLICATIONS

International Search Report dated Oct. 2, 2020 for corresponding PCT application Serial No. PCT/EP2020/070925, 6 pages.
International Written Opinion dated Oct. 2, 2020 for corresponding PCT application Serial No. PCT/EP2020/070925, 5 pages.

* cited by examiner

DRAG PUMP

CROSS-REFERENCE OF RELATED APPLICATION

This application is a Section 371 National Stage Application of International Application No. PCT/EP2020/070925, filed Jul. 24, 2020, and published as WO 2021/013979 A1 on Jan. 28, 2021, the content of which is hereby incorporated by reference in its entirety and which claims priority of British Application No. 1910647.5, filed Jul. 25, 2019.

FIELD

The field of the invention relates to the field of drag pumps.

BACKGROUND

Drag pumps operate by adding momentum to molecules in a fluid within the pump in a direction from an inlet towards an outlet. Channels on a stator surface of the pump run from an inlet towards an outlet. There is a corresponding rotor surface facing and close to the stator surface. Relative rotation of the two surfaces pushes gas molecules along the channels. Drag pumps may operate in both the molecular flow region and the continuous flow regions.

The walls of the channels in such a drag pump direct the flow of the molecules, so that increasing the length of the channels increases the compression. However, a longer channel generally requires an increase in the size of the pump which is often not desirable or even possible. An alternative to increasing the length of the pump is to decrease the angle of the channels, however this has the drawback of increasing the opportunity for reverse transmission of molecules. Narrowing the channels may decrease this effect but leads to an increase in power consumption.

It would be desirable to provide a compact drag pump with improved performance and without unduly high power consumption.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a drag pump for pumping fluid from an inlet to an outlet of said drag pump, said drag pump comprising a stator and a rotor; one of said stator or rotor comprising a disc, said disc comprising a plurality of channels, each of said channels extending from an inlet portion of said disc at or close to an inlet edge towards an outlet portion at or close to an outlet edge, said plurality of channels each comprising walls for guiding fluid flow from said inlet edge to said outlet edge in response to relative motion between said stator and said rotor; said disc further comprising a plurality of protrusions extending from said channels towards said rotor, each of said protrusions being arranged to divide a channel at said inlet or said outlet end of said channel, into sub-channels that extend for a portion of a length of said channel and do not extend for a whole length of said channel.

The inventors of the present invention recognised that problems with reverse transmission or back flow of fluids which leads to decreased efficiencies in pumps is particularly acute at the inlet and outlet ends of the pump. Thus, adapting a drag pump at or close to these ends allows these problems to be addressed without unduly affecting the other portions of the pump which may be operating more efficiently.

Thus, embodiments provide protrusions to divide channels towards the inlet and/or outlet ends into smaller sub-channels providing for improved pumping of the fluid at these parts of the pump while not unduly affecting power consumption which narrower channels running through the whole stage would do.

The inlet and outlet of the channels pose particular problems, with a significant length effectively only having one side wall owing to the angle of the channel at the edge of the stator. Providing protrusions to narrow the channel into sub-channels at one or both of the inlet and outlet reduces the width of the channels at the edges and thereby reduces the length of the channel where there is only one side wall. This in turn reduces the flow of fluid in the reverse direction. Were the channel widths to be reduced along the entire length of the channel, then the conductance would be affected and the power required to drive the pump increased. Providing what are in effect narrower channels only at an edge of the stator allows the advantage of these narrower channels to be felt at the points where the wider channels have the most detrimental effects. Maintaining the wider channels at least towards the middle portion of the stator allows the advantage of wider channels to be maintained for this portion of the channels.

In order to provide narrower channels, the protrusions run along a direction similar to that of the two walls that the protrusions lie between, in some embodiments, the protrusion runs substantially parallel to the two walls, or maintains a same distance from each.

It should be noted that for the pump to be able pump a fluid there must be relative motion between the rotor and the stator. Thus, the rotor and stator are mounted so that the rotor rotates with respect to the stator. There are two surfaces one on the rotor and one on the stator, facing each other and one of these has channels running from one edge to the other.

As noted above the protrusions are advantageous towards the inlet and/or outlet of the pump and less advantageous towards the middle. Thus, the length of a protrusion is less than the length of a channel wall and in some embodiments is less than 60% of a length of one of the walls which said protrusion is adjacent to.

In some embodiments, said protrusions do not extend along a mid portion of said channel. The mid portion is a portion between the inlet and the outlet and in some embodiments, is a portion including a mid point half way between the inlet and outlet of the channel, the portion extending for at least 10% of a length of a wall of said channel in both directions from the mid point.

Although it may only be a subset of channels that have protrusions within them, in some embodiments, said plurality of protrusions are arranged in each channel.

In some embodiments, the protrusions are at an inlet end of said channels.

The inlet end of the channel may have an increased width in some embodiments, to allow for compression of the gas as it passes through the pump. Thus, there may be a particular problem at the inlet end with recirculation of some of the gas molecules not hitting a wall and exiting the pump. Providing protrusions to effectively provide narrower sub-channels reduces this problem Additionally and/or alternatively, said plurality of protrusions are arranged in each channel at an outlet end of said channels.

At the outlet end of the channel there is an increased pressure due to the compression of the gas and this in turn can lead to undesirable recirculation of gas. Providing the additional wall will help reduce this, by providing a barrier for some of the gas molecules to re-enter the pump.

In some embodiments, said plurality of protrusions arranged at said inlet end of said channels extend from an inlet edge of said channel to a point beyond a line extending perpendicularly from an inlet end of said trailing wall of said channel.

As noted previously the protrusions run for a fraction of a length of the channel and the distance that they run will depend on the pump and the desired pumping conditions. It may however, be desirable to extend them at least as far as a point where a line extending perpendicularly from an inlet end of a trailing wall of the channel intersects the protrusion (see FIG. 2). This is the point at which the protrusion effectively forms a side wall with the end portion of the trailing wall of the channel. In some embodiments they are extended beyond this point so that 50% or less of the protrusion length lies beyond this point, preferably 10% or less The leading wall of a channel is the wall that leads the rotation where the channel is on a rotating disc or the wall that is first to pass each portion of the oncoming rotor where it is the rotor that moves. The trailing wall of a channel is the channel that follows the leading wall and passes portions of the rotor after the leading wall, the trailing wall may sometimes be termed the downstream wall.

In some embodiments, said plurality of protrusions arranged at said outlet end of said channels extend from an outlet edge of said channel to a point beyond a line extending perpendicularly from an outlet end of said leading wall of said channel.

As for the inlet case, this is the point at which the protrusion effectively forms a side wall with the end portion of, in this case, the trailing wall of the channel. In some embodiments they are extended beyond this point so that 50% or less of the protrusion length, preferably 10% or less, lies beyond this point.

In some embodiments, said plurality of protrusions are arranged such that said sub-channels have substantially the same cross sectional area. In other embodiments, said plurality of protrusions are arranged such that said sub-channels have different cross sectional areas.

The protrusion may bisect the channel and run substantially parallel with the channel walls, such that each of the sub-channels have effectively the same cross sectional area. Alternatively it may be advantageous for the sub channels on the upstream or downstream side to be narrower, in which case the protrusion may be located closer to one wall than to the other.

In some embodiments, said drag pump comprises a plurality of protrusions arranged in each channel such that said plurality of protrusions divides each channel into a plurality of three or more sub-channels.

Although there may only be one protrusion between the channel walls, in some embodiments there may be more than one, dividing the channels into multiple sub-channels. In some embodiments, they may all be substantially equally spaced so that the cross section of each sub-channel is substantially the same.

In some embodiments, the protrusions have a constant thickness, while in other embodiments, said protrusions have a thickness that varies along a length of said protrusions.

In some embodiments, said protrusions are configured to be thicker at an end adjacent to an edge of said disc and thinner towards a middle of said disc.

It may improve fluid flow if the protrusions are tapered away from an edge of the stator or rotor from which they extend, making the sub-channels narrower at the edges of the stator or rotor, where recirculation effects are particularly problematic.

In some embodiments, said inlet edge of said disc comprising an outer circumference of said disc.

Although the flow of the gas may be from the outer to the inner edge in some embodiments it is from the outer edge towards the inner edge. In the latter case, it may be particularly advantageous to have the protrusions sub dividing the channels towards the inlet as it is here that the width of the channels is particularly wide and the additional protrusions add to the drag felt by the gas being pumped.

In some embodiments, said drag pump comprises a Siegbahn drag pump. In some embodiments, said channels are formed on the surface of a disc shaped stator.

A Siegbahn pump is a drag pump which potentially suffers from recirculating gas problems at the inlet and/or outlet. In particular, owing to the disc shape the opening of the channel at the outer edge of the disc is wider than that at the inner edge. Thus, where the channel widths are selected for optimal overall flow, the widths at the outer edge may be wider than desired. Inserting additional projections into the channels at the outer edge to decrease the channel width here can be particularly advantageous. This outer edge may be the inlet edge of the stator or the outlet edge depending on the direction of relative rotation and the direction that the channels lie.

A related technique provides a Holweck drag pump with channels similar to those of the embodiment but being formed on a surface of a cylindrical stator rather than on a disc.

In some examples of the related technique, said pump further comprises a protrusion configured to extend across a portion of an outlet end of said channel adjacent to a leading wall of said channel.

One issue with Holweck drag pumps is that there is a bias for a skewed molecule density in the region of the channel towards the outlet such that the gas is denser adjacent to the trailing wall. Thus, the region adjacent to the leading wall provides a lower pressure region which recirculating molecules at the higher output pressure may be drawn towards. Thus, it may be advantageous to in effect block this portion of the outlet such that recirculating molecules cannot re-enter the pump at this point.

In some examples of the related technique, said portion comprises between a quarter and a half of said channel width.

The protrusion that acts to block a portion of the outlet is in some examples, said trailing wall of each channel which is configured to bend at the outlet and extend across said portion of an outlet of said channel. Alternatively, it may be formed by an annular washer attached to said outlet edge of said stator, said annular washer comprising projections arranged to extend across said portion of said outlet of each of said channels.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in any more detail, first an overview will be provided.

Embodiments provide the addition of short vanes or sealing lands at the outlet and/or or inlet of a drag pump either on the stator or the rotor between the walls forming the channels to provide reduced cross sectional sub-channels and impede recirculation and provide more pumping surface.

For a drag pump such as a Holweck stage the compression ratio increases as a function of channel length L and velocity $v \cdot \cos \alpha$, where $\alpha$ is the angle between the channel and the direction of rotation, $v \cdot \cos \alpha$ being the component of drag velocity along the channel.

Increasing rotational velocity for a drag pump has negative impacts on durability and balance, while increasing L, which is done in a Holweck pump by increasing the Holweck rotor & stator heights is in many applications undesirable as a pump's space claim is all too often limited.

The physical length of a channel can alternatively be increased by using a shallower channel angle, but as the angle reduces, the problems of recirculation of gases at the input and output, where there is a region of the channel that is in effect single sided, increases. This recirculation means that the flow back towards the inlet increases and we "lose" a considerable proportion of the extra length gained.

The mechanism by which a drag pumps works, and specifically a Holweck stage, is to influence the rate of relative flow of molecules (M12 from inlet to outlet, M21 from outlet to inlet) by adding a degree of momentum in the M12 direction. The geometry of the channels in conjunction with the direction of rotation of the rotor tend to bias the molecules towards the downstream or trailing wall as molecules pass through the stage, see FIG. 1.

Further at the inlet and particularly for shallow angle Holwecks, the opportunity for reverse transmission of molecules (to re-exit the inlet) remains until they are shrouded by the "upper" channel wall & thus have no direct path back out of the stage.

With a steep angled channel design the length of the channel is severely limited by the Holweck's height or in a Siegbahn disc by the Siegbahn's diameter, thus a shallower angle is preferred to increase the channel length. However, on a shallower angled channel (of the same channel width) though the channel length can be greatly increased, a significant length of the channel at both the inlet & exhaust has only one side wall, see FIG. 2, giving increased opportunity for a molecule having entered the pumping stage to re-exit, thus the effective working length of such a channel is much shorter than its physical dimensions.

Figure 1:
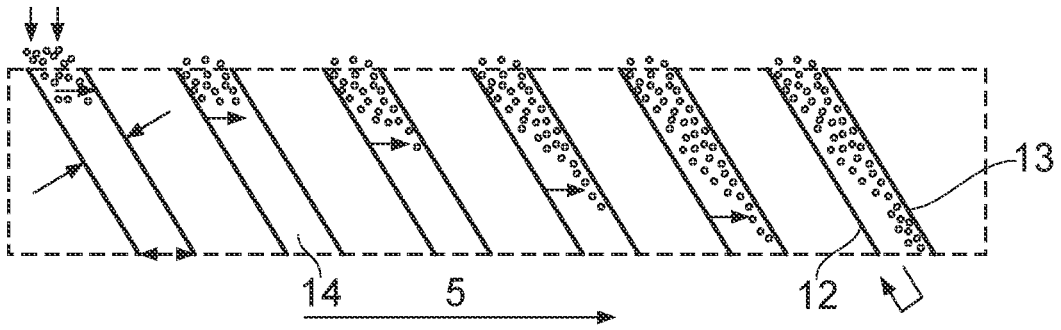
FIG. 1 schematically shows molecules being pumped through a channel in a stator of a drag pump, where for the sake of the Figure the channel has been unwrapped.

FIG. 1 schematically show flow in a drag pump as it progresses through a channel 14, between walls 12 and 13. The walls are the walls of a channel on a static stator, the arrow 5 showing the direction of rotation of the rotor, so that wall 12 is the upstream or leading wall as this meets the rotor first, while wall 13 is the downstream or trailing wall. The movement of the rotor drags gas towards downstream or trailing wall 13, which deflects the gas towards the outlet. Owing to this movement the molecules become more concentrated close to the downstream or trailing wall 13 towards the outlet.

Figure 2:
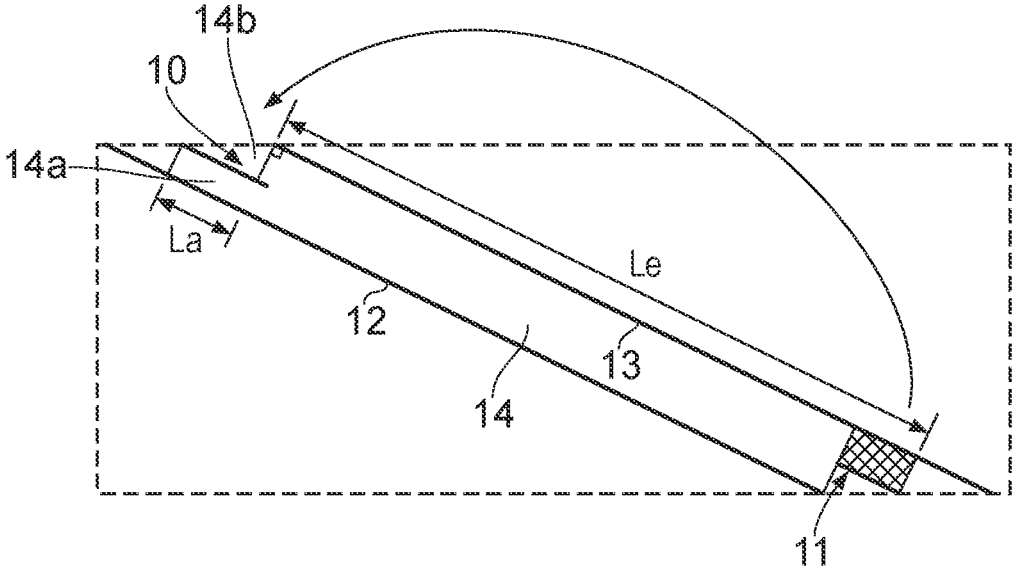
FIG. 2 shows an "unwrapped" channel of a drag pump according to an embodiment.

FIG. 2 shows how the effective channel length Le can be increased by an amount La by the use of an inlet splitter vane 10, which protrudes from the channel surface and acts as an additional wall to the walls 12, 13 of channel 14 and in effect provides two subchannels 14*a* and 14*b* at the inlet of the pump.

Figure 4:
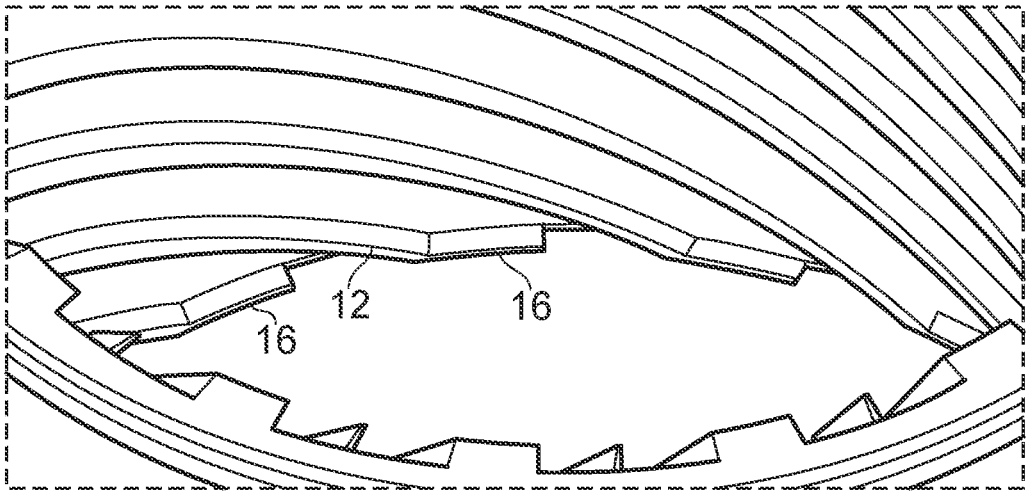
FIG. 4 shows an overview of an outlet end of a stator of a drag pump according to a related technique.

In effect this protrusion or splitter vane creates an extension to the upper or leading channel wall 13 and provides positive blockage extending the effective channel length and thus reducing back leakage. FIG. 4-2 also shows a protrusion 11 at the outlet end of the channel.

Figure 3:
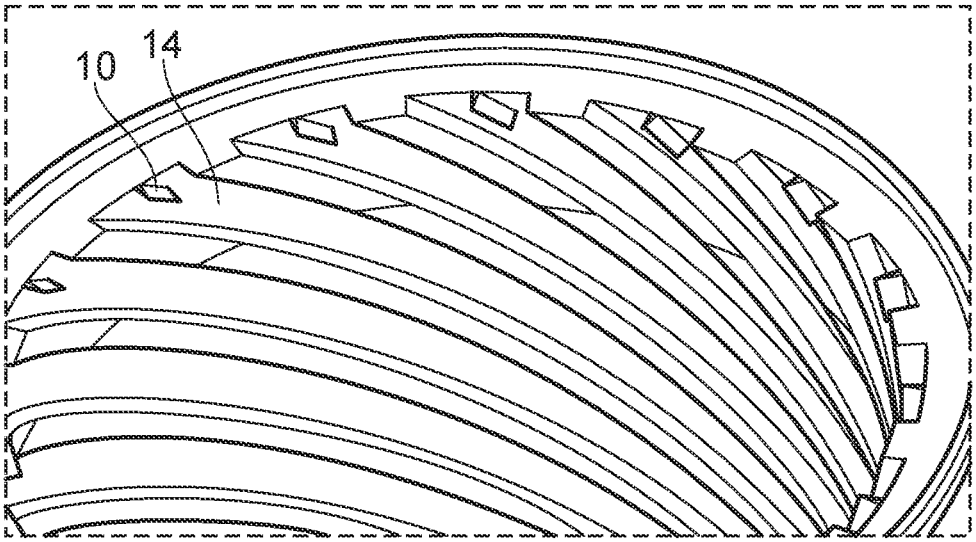
FIG. 3 shows an overview of a stator of a drag pump according to related technique.

FIG. 3 shows the channels 14 and protrusions 10 as an overview in a Holweck pump of a related technique.

In the embodiment of FIG. 2 the protrusions at the inlet and outlet end are the same. However, in other embodiments, the protrusions at the outlet end may be different and may act to block a portion of the outlet adjacent to the leading wall 12 of the channel as opposed to dividing the channel. In this regard in a Holweck pump of a related technique there is a bias for a skewed molecule density in the lower regions of a Holweck channel and thus, the portion of the channel adjacent to the leading wall 12 has a lower density of gas molecules and a corresponding lower pressure. This makes it not particularly effective at pumping the gas and also provides a path for the re-entry of gas molecules at the higher pressure of the pump exhaust. Thus, in some embodiments, there may be a protrusion 16 that extends to block a portion of the outlet adjacent to the leading wall 12. This can be provided by a washer 18 that has protrusions 16 on it as shown in FIG. 5 and which is mounted onto the outlet end of the drag stage or it can be formed by an extension to the end of wall 12 at the channel exit as is shown in FIGS. 4 and 6.

Figure 5:
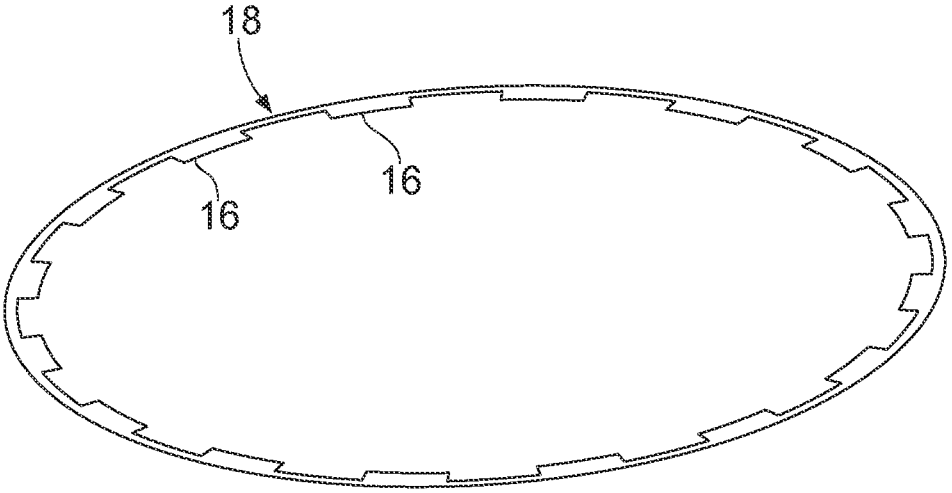
FIG. 5 shows an annular washer for providing blocking of a portion of an outlet of channels of a stator according to a related technique.
Figure 6:
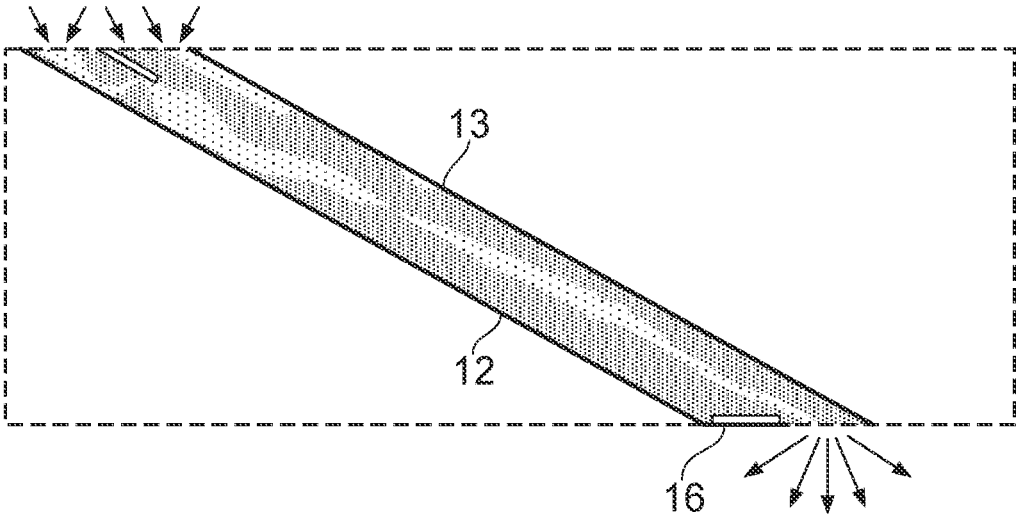
FIG. 6 schematically shows the flow of molecules within a channel of a pump according to an embodiment.

The protrusions of FIGS. 4 and 6 are formed as an integral machined feature of the Holweck stator, while in FIG. 5 they are formed as a separate entity by means of a simple thin "castellated washer".

This design not only extends the effective Holweck channel length, but also adds a positive block to aid reverse transmission of molecules that have left the Holweck stage.

Figure 7:
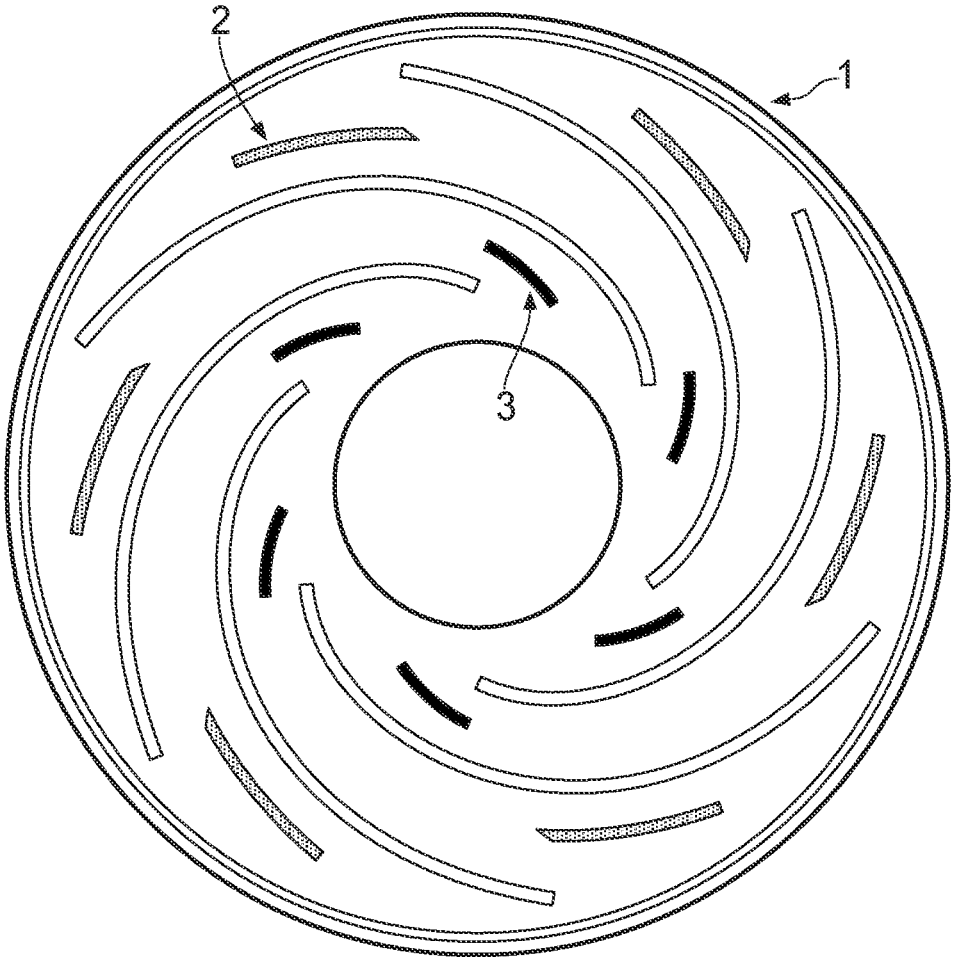
FIG. 7 schematically shows the stator of a Siegbahn pump according to embodiment.

FIG. 7 shows an embodiment, where the pump is a Siegbahn drag stage. The Siegbahn mechanism, while relying on a similar operating principle to the Holweck mechanism has the added challenge of increased difficulty controlling inlet and outlet areas as the outer edge of the Siegbahn stator, whether inlet or outlet, is necessarily larger than the inner edge. This can cause problems in controlling inlet/outlet area ratio and also in managing the gas flow at the outer edge, which is likely to have significant recirculation, particularly at low flows. This means that it can be difficult to manage stage volume ratios and to control the recirculation of gas, particularly at the outside edge of the blade stator.

FIG. 7 shows an embodiment configured to mitigate these effects. In this embodiment stator 1 is modified, by adding short, thin splitter sealing lands 2 in the channels at the outer edge and optionally adding the splitter sealing lands 3 at the inner edge. The addition of these lands or protrusions will have the following benefits:

1. The large recirculation at the outer edge, particularly at low flow will be reduced.
2. There will be extra pumping due to the drag on the additional sealing lands.

In summary a relatively short blade or splitter land will help address the recirculation and area ratio problems encountered by Siegbahn stages.

Although in FIG. 7 the protrusions are shown at both the inner and outer edges, there may only be protrusions at one of the edges. Furthermore, there may be more than one protrusion or sealing land within each channel, particularly at the outer edge where the channels are wider. The sealing lands or protrusions 2 are shown as being of a uniform width, but in some embodiments, they may have a tapered shape, such as a wedge type shape which tapers towards the middle of the stator, allowing improved control of inlet and outlet areas.

In summary advantages of embodiments include

Maintaining capacity at the inlet & compression at the outlet;

Enhanced pump performance within a pump particular space envelope.

Figure 8:
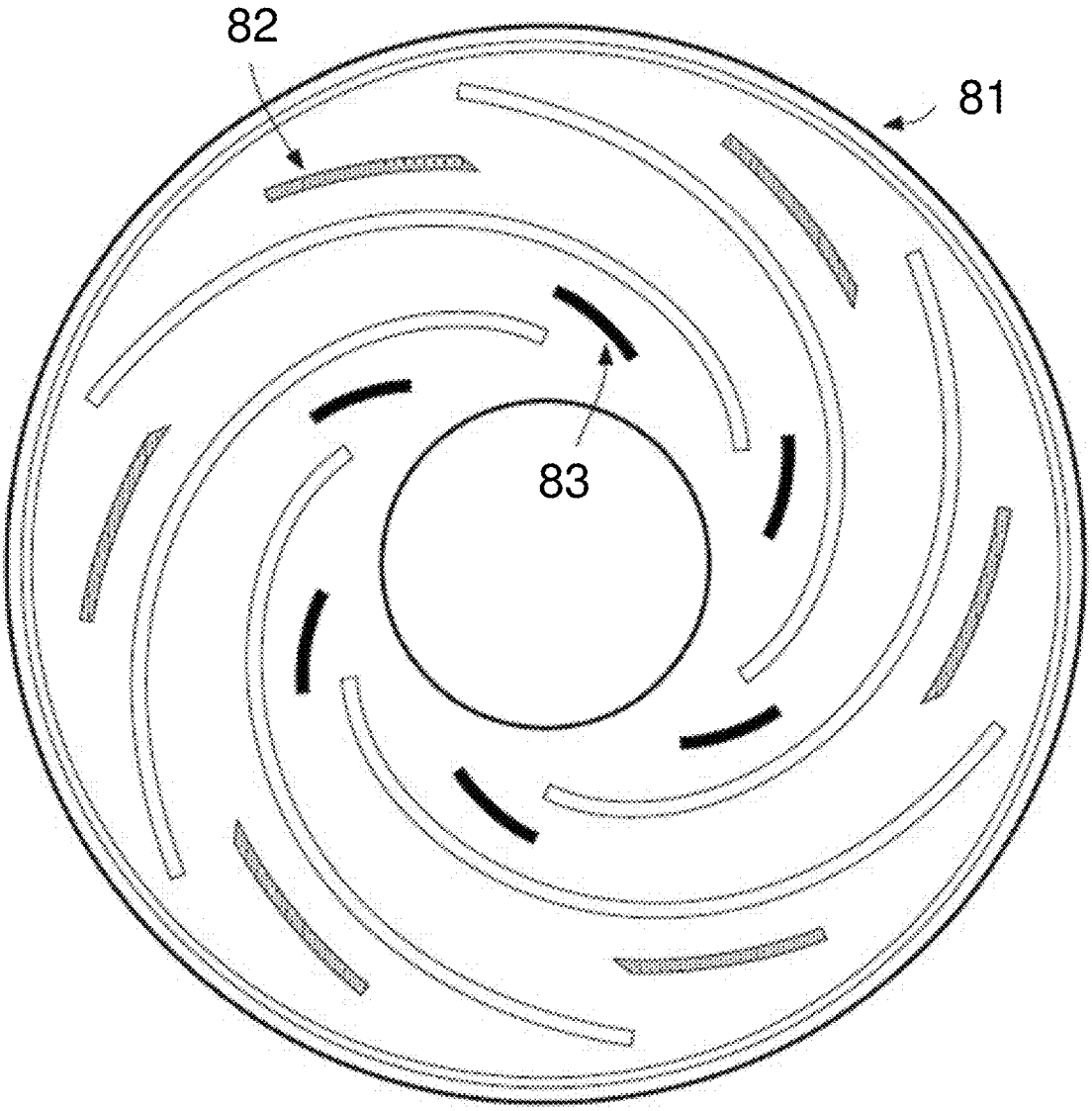
FIG. 8 schematically shows the rotor of a Siegbahn pump according to embodiment.

FIG. 8 shows an embodiment where the pump is a Siegbahn drag stage and the rotor 81 of the Siegbahn drag stage contains channels. In this embodiment, rotor 81 is modified, by adding short, thin splitter sealing lands 82 in the channels at the outer edge and optionally adding the splitter sealing lands 83 at the inner edge.

Although in FIG. 8 the protrusions are shown at both the inner and outer edges, there may only be protrusions at one of the edges. Furthermore, there may be more than one protrusion or sealing land within each channel, particularly at the outer edge where the channels are wider. The sealing lands or protrusions 82 are shown as being of a uniform width, but in some embodiments, they may have a tapered shape, such as a wedge type shape which tapers towards the middle of the stator, allowing improved control of inlet and outlet areas.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A drag pump for pumping fluid from an inlet to an outlet of said drag pump, comprising:

a stator and a rotor;

one of said stator or said rotor comprising a disc comprising a plurality of channels, each of said channels extending from an inlet end at or close to an inlet edge towards an outlet end at or close to an outlet edge, said plurality of channels each comprising walls for guiding fluid flow from said inlet edge to said outlet edge of said disc in response to relative motion between said stator and said rotor;

said disc further comprising a plurality of protrusions extending from said channels towards said other of said rotor or said stator, each of said protrusions being arranged to divide a channel of said plurality of channels at said inlet end of said channel, into sub-channels that extend for a portion of a length of said channel and do not extend for a whole length of said channel.

2. The drag pump according to claim 1, wherein said protrusions do not extend along a mid portion of said channel.

3. The drag pump according to claim 1, wherein said protrusions have a length that is less than 60% of a length of one of said walls which said protrusion is adjacent to.

4. The drag pump according to claim 1, further comprising a second plurality of protrusions, each protrusion in the second plurality of protrusions arranged in an outlet end of a respective channel.

5. The drag pump according to claim 1, wherein said plurality of protrusions arranged at said inlet end of said channels extend from said inlet edge of said channel to a point beyond a line extending perpendicularly from a trailing wall of said channel.

6. The drag pump according to claim 5, wherein 50% or less of said protrusion extends beyond the line perpendicular to said trailing wall of said channel.

7. The drag pump according to claim 1, wherein said plurality of protrusions are arranged such that said sub-channels have substantially the same cross section.

8. The drag pump according to claim 1, wherein said plurality of protrusions are arranged such that said sub-channels each have a different cross sectional area.

9. The drag pump according to claim 1, wherein said plurality of protrusions divides each channel into three or more sub-channels.

10. The drag pump according to claim 1, wherein said protrusions have a thickness that varies along a length of said protrusions.

11. The drag pump according to claim 10, wherein said protrusions are configured to be thicker at an end adjacent to an edge of said disc and thinner towards a middle of said disc.

12. The drag pump according to claim 1, said inlet end of said disc comprising an outer circumference of said disc.

13. The drag pump according to claim 1, wherein said drag pump comprises a Siegbahn drag pump, said channels being formed on a surface of a disc shaped stator.

14. A drag pump for pumping fluid from an inlet to an outlet of said drag pump, comprising:

a stator and a rotor;

one of said stator or said rotor comprising a disc comprising a plurality of channels, each of said channels extending from an inlet portion of said disc at or close to an inlet edge towards an outlet portion at or close to an outlet edge, said plurality of channels each comprising walls for guiding fluid flow from said inlet edge to said outlet edge of said disc in response to relative motion between said stator and said rotor;

said disc further comprising a plurality of protrusions extending from said channels towards said other of said rotor or said stator, each of said protrusions being arranged to divide a channel of said plurality of channels at said inlet portion or said outlet portion of said channel, into sub-channels that extend for a portion of a length of said channel and do not extend for a whole length of said channel, wherein said protrusions have a thickness that varies along a length of said protrusions.

15. A drag pump for pumping fluid from an inlet to an outlet of said drag pump, comprising:

a stator and a rotor;

one of said stator or said rotor comprising a disc comprising a plurality of channels, each of said channels extending from an inlet portion of said disc at or close to an inlet edge towards an outlet portion at or close to an outlet edge, said inlet portion of said disc comprising an outer circumference of said disc, said plurality of channels each comprising walls for guiding fluid flow from said inlet edge to said outlet edge of said disc in response to relative motion between said stator and said rotor;

said disc further comprising a plurality of protrusions extending from said channels towards said other of said rotor or said stator, each of said protrusions being arranged to divide a channel of said plurality of channels at said inlet portion or said outlet portion of said channel, into sub-channels that extend for a portion of a length of said channel and do not extend for a whole length of said channel.

* * * * *